US010507651B2

(12) United States Patent
Kuronuma

(10) Patent No.: US 10,507,651 B2
(45) Date of Patent: Dec. 17, 2019

(54) PRINTING DEVICE, PRINTING METHOD, AND NON-TRANSITORY RECORDING MEDIUM

(71) Applicant: CASIO COMPUTER CO., LTD., Shibuya-ku, Tokyo (JP)

(72) Inventor: Hirotaka Kuronuma, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/138,797

(22) Filed: Sep. 21, 2018

(65) Prior Publication Data

US 2019/0091994 A1 Mar. 28, 2019

(30) Foreign Application Priority Data

Sep. 27, 2017 (JP) ..... 2017-185772

(51) Int. Cl.
*B41J 2/045* (2006.01)
*B41J 3/00* (2006.01)
*B41J 3/36* (2006.01)

(52) U.S. Cl.
CPC ..... *B41J 2/0455* (2013.01); *B41J 2/04586* (2013.01); *B41J 3/00* (2013.01); *B41J 3/36* (2013.01); *B41J 2/04508* (2013.01)

(58) Field of Classification Search
CPC ..... B41J 25/006; B41J 29/38; B41J 2/04556; B41J 2/0455; B41J 2/04586; B41J 2/04508; B41J 2/04505; B41J 2/0458; B41J 3/00; B41J 3/36
See application file for complete search history.

(56) References Cited

U.S. PATENT DOCUMENTS 6,543,874 B2 * 4/2003 Matsumoto ..... B41J 3/28 347/14
7,812,994 B2 10/2010 Carlson et al.
7,944,580 B2 5/2011 Carlson et al.
8,125,678 B2 2/2012 Carlson et al.

FOREIGN PATENT DOCUMENTS

JP 2006341604 A 12/2006

* cited by examiner

*Primary Examiner* — Thinh H Nguyen
(74) *Attorney, Agent, or Firm* — Holtz, Holtz & Volek PC

(57) ABSTRACT

A printing device includes a print head that prints on a print medium image data of a print target and a decorative image and a processor that controls the print head to print image data of the decorative image on the print medium while the printing device that is held by a user moves on the print medium in a first movement, wherein the processor causes the print head to print the image data of the print target in a range that is indicated by the printed decorative image while the held printing device moves on the print medium in a second movement after the image data of the decorative image is printed.

10 Claims, 8 Drawing Sheets

PRINTING DEVICE, PRINTING METHOD, AND NON-TRANSITORY RECORDING MEDIUM

CROSS-REFERENCE TO RELATED APPLICATION

This application is based upon and claims the benefit of priority under 35 USC 119 of Japanese Patent Application No. 2017-185772 filed on Sep. 27, 2017, the entire disclosure of which, including the description, claims, drawings, and abstract, is incorporated herein by reference in its entirety.

FIELD

This application relates generally to a printing device, a printing method, and a non-transitory recording medium.

BACKGROUND

Unexamined Japanese Patent Application Kokai Publication No. 2006-341604 discloses a hand-held printer that has a navigation sub-system for tracking movement of the hand-held printer with respect to a print surface and a print head controller for ejecting ink to the print surface from the print head according to the movement and an image that is saved in the image buffer. The hand-held printer that is disclosed in Unexamined Japanese Patent Application Kokai Publication No. 2006-341604 determines the boundary of a print region by being moved by the user and prints an image that is enlarged or reduced in accordance with the boundary. The hand-held printer of the Unexamined Japanese Patent Application Kokai Publication No. 2006-341604 is capable of setting the boundary of a print region and printing an image that is enlarged or reduced in accordance with the print region. However, a problem is that no images that indicate a print region such as border lines are printed and the user cannot view the print range that is set by the user. The present disclosure provides a printing device, a printing method, and a non-transitory recording medium that advantageously enables the user to easily set and view a print range.

SUMMARY

One mode of the printing device according to the present disclosure includes a print head that prints, on a print medium, image data of a print target and a decorative image and a processor that controls the print head to print image data of the decorative image on the print medium while the printing device that is held by a user moves on the print medium in a first movement, wherein the processor causes the print head to print the image data of the print target in a range that is indicated by the printed decorative image while the held printing device moves on the print medium in a second movement after the image data of the decorative image is printed.

One mode of the printing method according to the present disclosure is a printing method of a printing device that includes a print head for printing image data of a print target on a print medium wherein the following is executed: a decorative print procedure in which the print head is controlled to print image data of a decorative image on the print medium while the printing device that is held by a user moves on the print medium in a first movement and a print procedure in which the print head is controlled to print the image data of the print target in a range that is indicated by the printed decorative image while the held printing device moves on the print medium in a second movement after the image data of the decorative image is printed.

One mode of the non-transitory recording medium according to the present disclosure records a program that causes a computer of a printing device that includes a print head for printing image data of a print target on a print medium to execute the following processing: controlling the print head to print image data of a decorative image on the print medium while the printing device that is held by a user moves on the print medium in a first movement and controlling the print head to print the image data of the print target in a range that is indicated by the printed decorative image while the held printing device moves on the print medium in a second movement after the image data of the decorative image is printed.

BRIEF DESCRIPTION OF THE DRAWINGS

A more complete understanding of this application can be obtained when the following detailed description is considered in conjunction with the following drawings, in which.

DETAILED DESCRIPTION

A printing device 1 according to an embodiment will be described with reference to the drawings. Here, the same or corresponding parts are referred to by the same reference numbers.

Figure 1A:
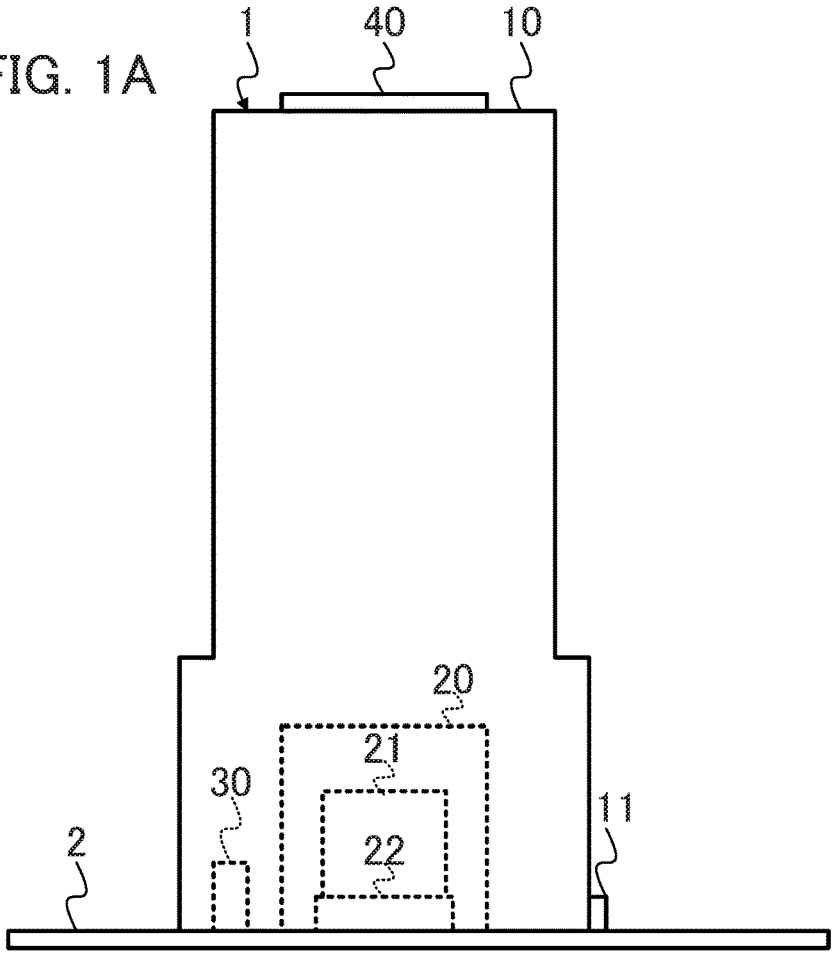
FIG. 1A is a side view of the printing device.
Figure 1B:
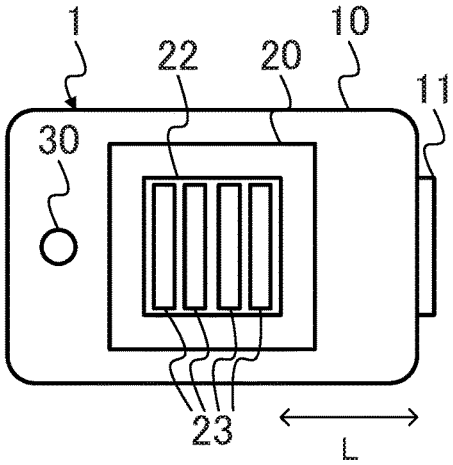
FIG. 1B is a bottom view of the printing device.
Figure 2:
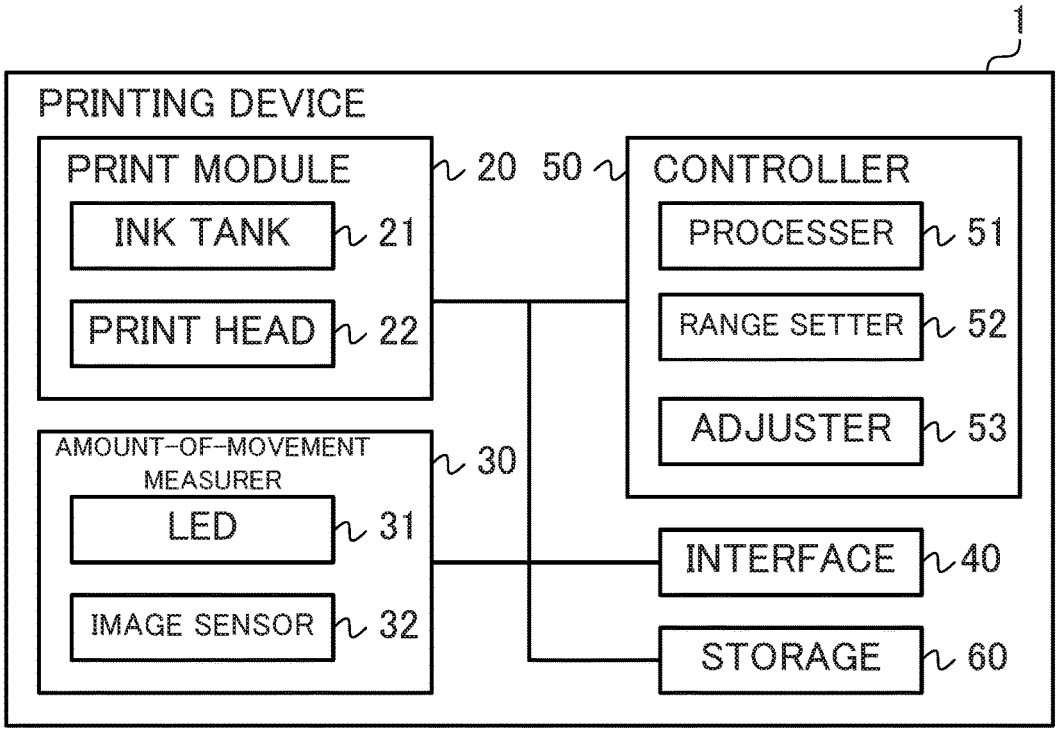
FIG. 2 is a block diagram that shows the configuration of the printing device.

FIG. 1A is a side view of the printing device 1 according the embodiment and FIG. 1B is a bottom view thereof. FIG. 2 is a block diagram that shows the configuration of the printing device 1. The printing device 1 is a manual-scan type printing device with which the user can print a print-target image (image data) on a print medium 2 by moving the printing device 1 on the print medium in a sliding fashion. Such a manual-scan type printing device is also called a handy printer or a direct printer.

The print medium 2 can include, but not limited to, print paper, print labels, and cardboard. The print medium 2 is also referred to as a recording medium or a print object. The print medium 2 is formed of paper or resin. However, the print medium 2 can be anything that is formed of a material to which ink can adhere with a surface condition under which ink can adhere.

A print-target image 100 can include, but not limited to, characters, symbols, figures, patterns, drawings, and pictures. The print-target image 100 is also referred to as a print image or a print pattern.

Figure 3:
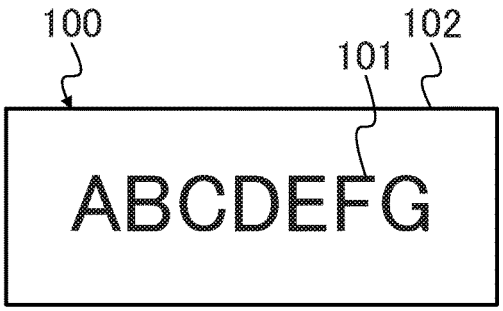
FIG. 3 is an illustration that shows a print-target image.

FIG. 3 is an illustration that shows the print-target image 100. As shown in FIG. 3, the print-target image 100 includes a print-target part 101 and a decorative image 102. The print-target part 101 can include, but not limited to, characters, symbols, figures, patterns, drawings, and pictures. The decorative image 102 has a rectangular shape that encloses the print-target part 101.

Back to FIGS. 1A and 1B and FIG. 2. As shown in FIGS. 1A and 1B and FIG. 2, the printing device 1 according to the embodiment includes an enclosure 10, a print module 20, an amount-of-movement measurer 30, an interface 40, a controller 50, and a storage 60.

The enclosure 10 is an enclosure in which the print module 20, the amount-of-movement measurer 30, the interface 40, the controller 50, and the storage 60, which are components of the printing device 1, are disposed. As shown in FIGS. 1A and 1B, the print head 22 that is described later, the amount-of-movement measurer 30, and the interface 40 are exposed from the enclosure 10. The enclosure 10 is formed of resin or metal but not limited thereto. The enclosure 10 includes a marker 11 on a surface that adjoins the surface on which the print head 22 is disposed. The enclosure 10 is also referred to as a device body 10. The enclosure 10 includes a substrate, a battery, and the like therein although they are not shown or described.

The marker 11 indicates to the user the width of the print head 22 and indicates the print start position. The marker 11 has the same width as the print head 22. As shown in FIG. 1B, the distance between the marker 11 and the print head 22 is L. The distance L is also referred to as an offset L.

The print head 22 is disposed and fixed on the underside of the enclosure 10 and prints the print-target image 100 on the print medium 2. The print module 20 includes an ink tank 21 that is filled with ink and a print head 22 that atomizes and ejects ink contained in the ink tank 21. The print head 22 performs inkjet printing. The ink tank 21 supplies ink to the print head 22. The print head 22 includes multiple nozzles 23 that are arrayed along the main scan direction and the sub-scan direction. The print head 22 heats the ink within the nozzles 23 with a heater to form air bubbles and ejects the ink from the individual nozzles 23 to the print medium 2 by means of the formed air bubbles.

The amount-of-movement measurer 30 is a sensor that measures the relative amount of movement to the print medium 2 of the printing device 1 and the print head 22 that is disposed on the printing device 1. As shown in FIG. 2, the amount-of-movement measurer 30 includes a light emitting diode (LED) 31 and an image sensor 32. With the image sensor 32 reading light that is emitted by the LED 31 and reflected on the print medium 2 and comparison of the reflected light before and after the movement, the amount-of-movement measurer 30 measures the amount of movement and the moving direction of the printing device 1. The amount-of-movement measurer 30 provides to the controller 50 data including the measured amount of movement and moving direction.

The interface 40 is an interface that receives from the user input including decorative print start and decorative print stop orders and presents information to the user. The interface 40 provides the received print start or print stop order to the controller 50 and presents to the user information that is acquired from the controller 50. The interface 40 can include, but not limited to, buttons, keys, or a touch pad for receiving input from the user, a liquid crystal display or a speaker for presenting information to the user, or a touch panel for the both.

The controller 50 is a processing device (processor) that executes programs to control the printing device 1. The controller 50 includes a processor 51, a range setter 52, and an adjuster 53. The controller 50 can include, but not limited to, a central processing unit (CPU).

As the interface 40 receives a decorative print start order, the processor 51 acquires decorative print start order information from the interface 40 and controls the print head 22 to start printing. At this point, the enclosure 10 is held by the user and the printing device 1 is moved for printing (first movement). The processor 51 acquire the amount of movement that is measured by the amount-of-movement measurer 30 and controls the print head 22 to print part of the decorative image 102 that corresponds to the position of the print head 22. As the interface 40 receives a decorative print end order, the processor 51 acquires decorative print end order information from the interface 40 and controls the print head 22 to stop printing.

As the interface 40 receives a print start order, the processor 51 acquires print start order information from the interface 40 and determines whether it is first-time printing. If it is first-time printing, in other words if it is the first time to print after the decorative print is performed, the processor 51 controls the print head 22 to start printing the print-target part 101 of the print-target image 100. At this point, the enclosure 10 is held by the user and the printing device 1 is moved for printing (second movement). The processor 51 acquires the amount of movement that is measured by the amount-of-movement measurer 30 and controls the print head 22 to print part of the print-target part 101 that corresponds to the position of the print head 22. After printing the entire print-target part 101 that is to be printed, the processor 51 controls the print head 22 to stop printing.

If it is not first-time printing, in other words if it is non-first-time printing, the processor 51 controls the print head 22 to start printing a combined image 103 in which the print-target part 101 and the decorative image 102 of the print-target image 100 are combined together. The process of printing is the same as in the first-time printing.

The range setter 52 sets the size of the decorative image 102 that is printed by the processor 51 as the print range. The range setter 52 acquires from the amount-of-movement measurer 30 the amount of movement of the printing device 1 from the interface 40 receiving a decorative print start order to receiving a decorative print end order, and sets the acquired length as the length of one side of the print range. The range setter 52 sets the width of the print head 22 as the length of the sides that adjoin the one side.

The adjuster 53 adjusts the print-target part 101 of the print-target image 100 to fit in the print range that is set by the range setter 52. If the print-target part 101 of the print-target image 100 is a character string, the adjuster 53 enlarges or reduces the characters, changes the number of lines, selects a font, and/or the like so that the print-target part 101 fits in the decorative image 102. If the print-target image 100 is a pattern, a drawing, or a picture, the image is enlarged or reduced so that the print-target part 101 is adjusted to fit in the decorative image 102. Adjustment by the adjuster 53 is not restricted to the above examples.

The adjuster 53 combines the decorative image 102 of the same size as the printed decorative image 102 and the adjusted print-target part 101 to create a combined image 103.

The storage 60 stores programs and data for the controller 50 to execute the processing and functions as the work area for the controller 50 to execute the processing. The storage 60 can store a program for controlling the print head 22 to print, a program for controlling the amount-of-movement measurer 30 to measure the amount of movement, a program for setting the print range, a program for adjusting the print-target image 100, the coordinates of the print head 22, and data of the print-target image 100. However, what is stored is not restricted to these. The storage 60 can include, but not limited to, a read only memory (ROM) and a random access memory (RAM).

Figure 4:
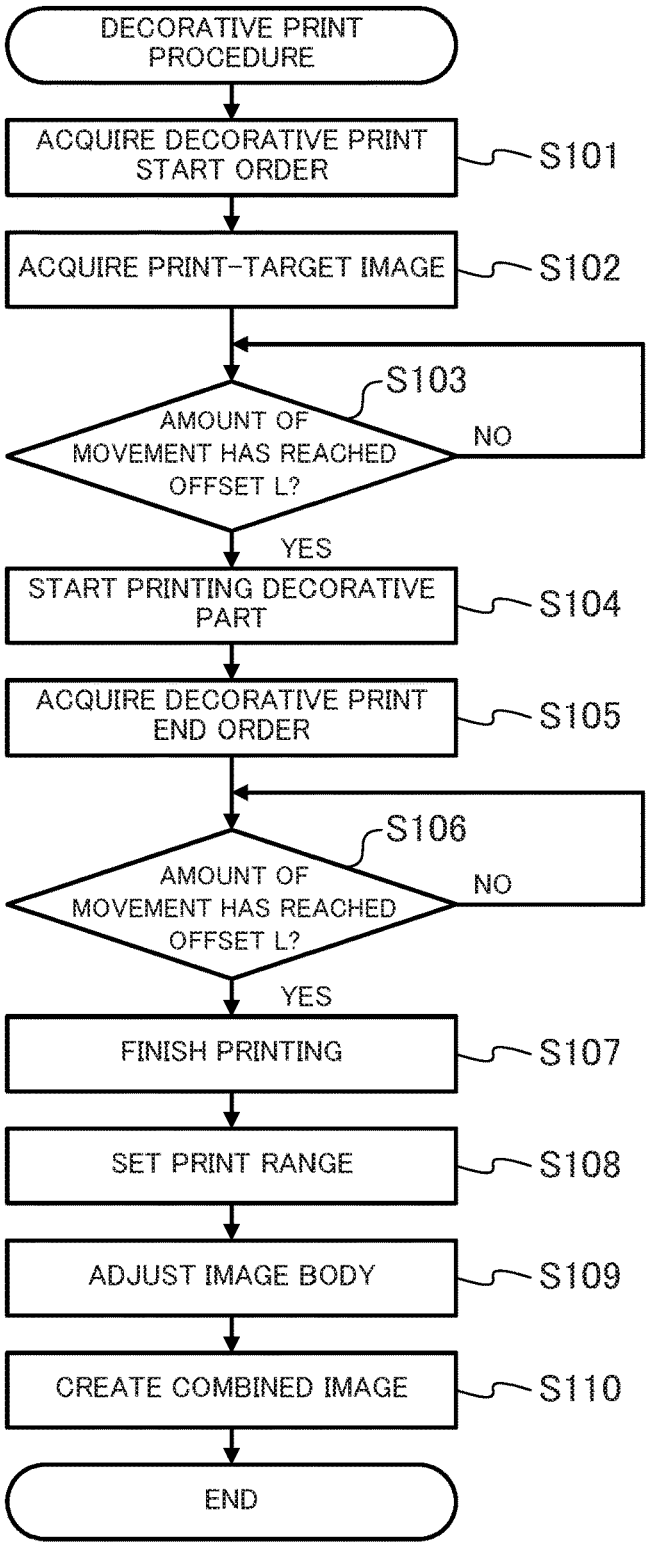
FIG. 4 is a flowchart of the decorative print procedure.

FIG. 4 is a flowchart of the decorative print procedure that is executed by the printing device 1. The decorative print procedure that is executed by the printing device 1 will be described with reference to the flowchart of FIG. 4.

As the decorative print procedure starts, the interface 40 receives a decorative print start order from the user and the controller 50 acquires the decorative print start order from the interface 40 (Step S101).

Acquiring the decorative print start order, the controller 50 acquires a print-target image 100 from the storage 60 (Step S102).

Acquiring the print-target image 100, the controller 50 acquires the amount of movement of the printing device 1 from the amount-of-movement measurer 30 and determines whether the amount of movement since acquisition of the decorative print start order has reached the offset L (Step S103). If the amount of movement has not reached the offset L (Step S103: NO), the determination is repeated until the amount of movement has reached the offset L.

If the amount of movement has reached the offset L (YES in step S103), the processor 51 controls the print head 22 to start printing the decorative image 102 of the print-target image 100 (Step S104).

As printing of the decorative image 102 starts, the interface 40 receives a decorative print end order from the user and the controller 50 acquires the decorative print end order from the interface 40 (Step S105).

Acquiring the decorative print end order, the controller 50 acquires the amount of movement of the printing device 1 from the amount-of-movement measurer 30 and determines whether the amount of movement since acquisition of the decorative print end order has reached the offset L (Step S106). If the amount of movement has not reached the offset L (NO in step S106), the determination is repeated until the amount of movement has reached the offset L.

If the amount of movement has reached the offset L (YES in step S106), the processor 51 controls the print head 22 to finish printing (Step S107).

As the printing is finished, the range setter 52 acquires from the amount-of-movement measurer 30 the amount of movement of the printing device 1 from the interface 40 receiving the decorative print start order to receiving the decorative order end order, and sets the size of the decorative image 102 that is printed by the processor 51 as the print range (Step S108).

As the print range is set, the adjuster 53 adjusts the print-target part 101 of the print-target image 100 to fit in the print range that is set by the range setter 52 (Step S109).

As the print-target part 101 is adjusted, the adjuster 53 combines the decorative image 102 of the same size as the printed decorative image 102 and the adjusted print-target part 101 to create a combined image 103 (Step S110) and ends the decorative print procedure.

Figure 5A:
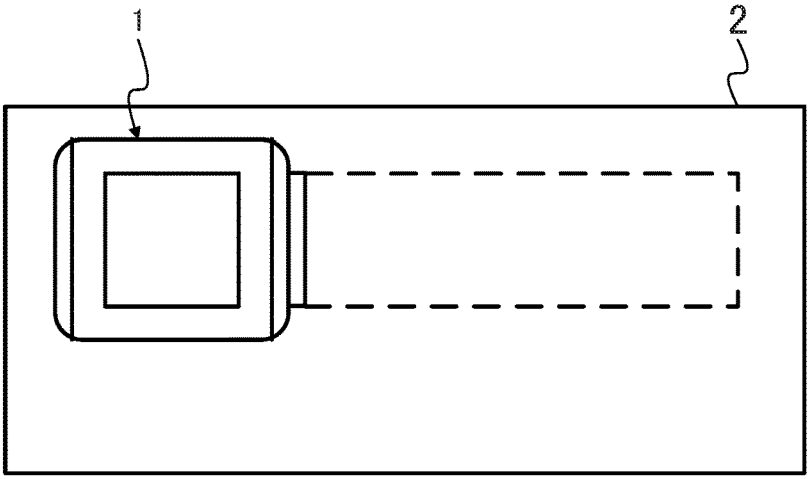
FIG. 5A is an illustration that shows the printing device and the print medium before decorative print.
Figure 5B:
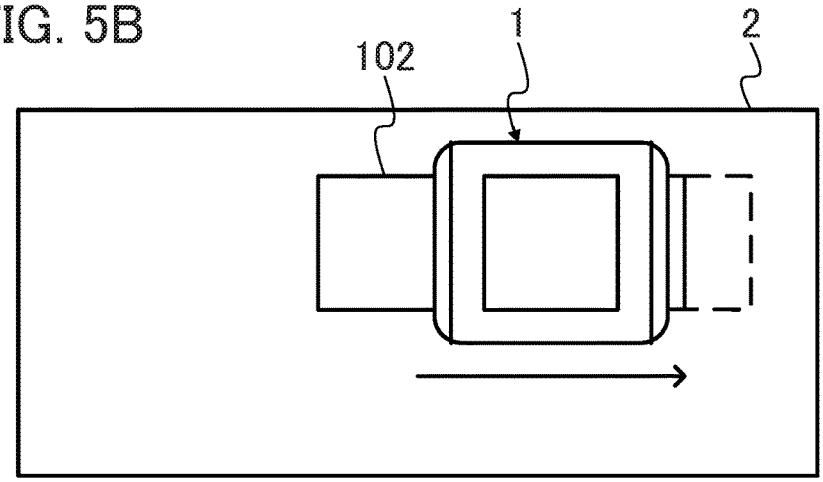
FIG. 5B is an illustration that shows the printing device and the print medium during decorative print.
Figure 5C:
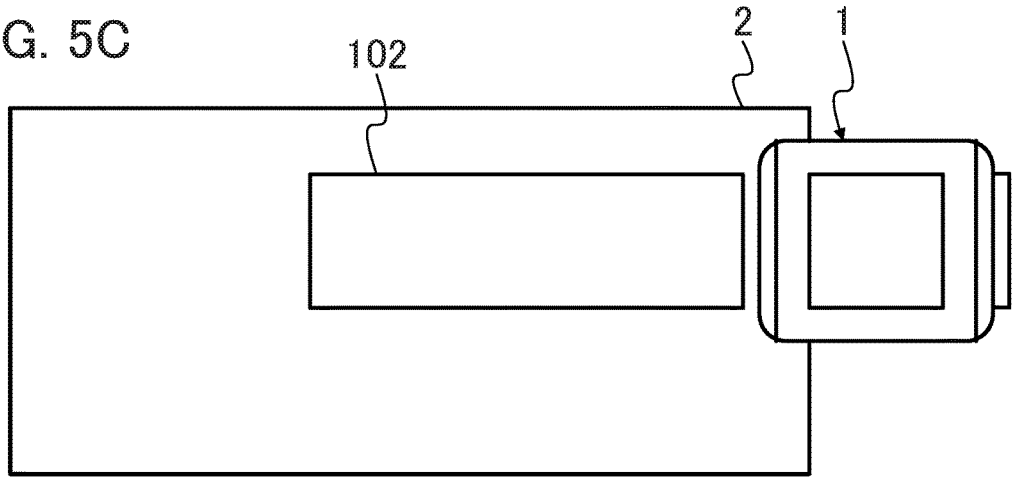
FIG. 5C is an illustration that shows the printing device and the print medium after decorative print.

FIGS. 5A to 5C are illustrations that show the printing device 1 and the print medium 2 to print the decorative image 102. The dashed lines in FIGS. 5A and 5B indicate a range in which the user wants to print. As shown in FIG. 5A, the user disposes the printing device 1 so that the marker 11 is positioned at the left end of the range in which the user wants to print and enters a decorative print start order into the interface 40.

As shown in FIG. 5B, the user scans the printing device 1 in the arrowed direction from left to right. When the marker 11 is positioned at the right end of the range in which the user wants to print, the user enters a decorative print end order into the interface 40.

The printing device 1 continues to print after receiving a decorative print end order at the interface 40 and finishes printing the decorative image 102 after being scanned by L. In this way, the decorative image 102 is printed on the print medium 2 as shown in FIG. 5C.

Figure 6:
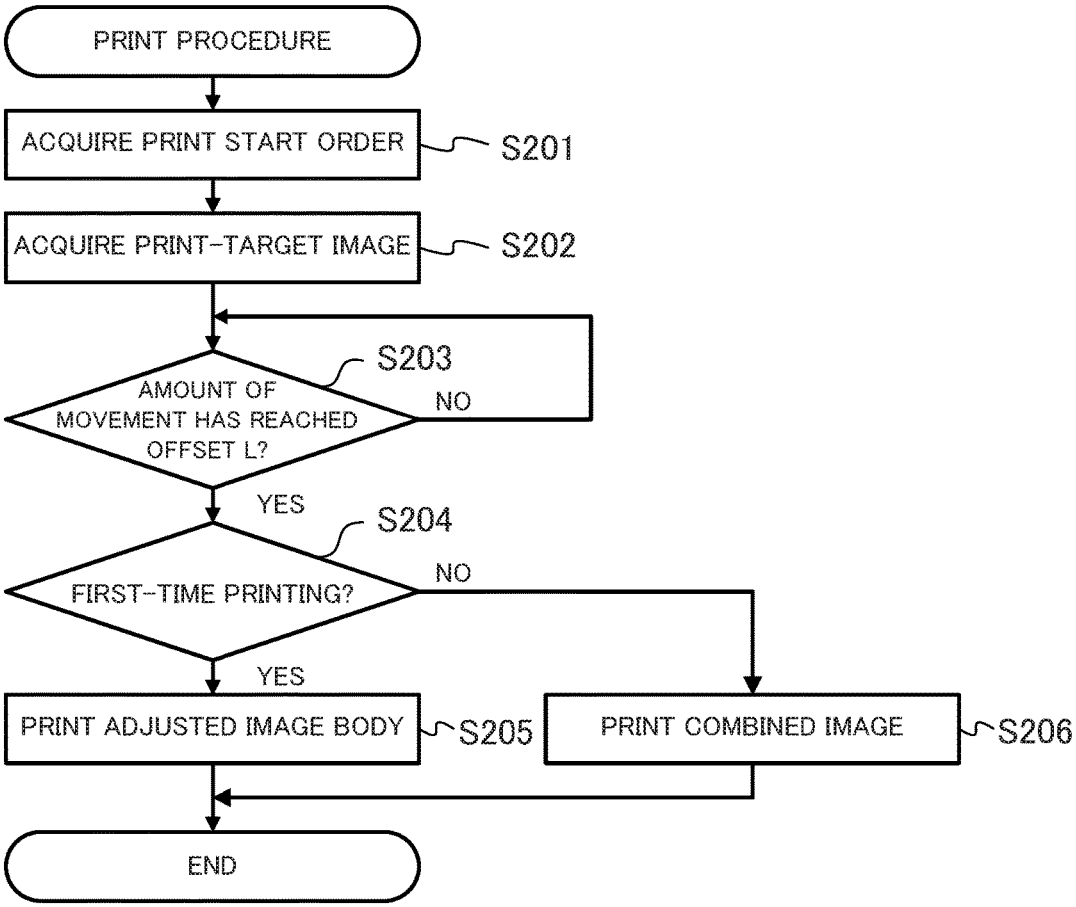
FIG. 6 is a flowchart of the print procedure.

FIG. 6 is a flowchart of the print procedure that is executed by the printing device 1. The print procedure that is executed by the printing device 1 will be described with reference to the flowchart of FIG. 6.

As the print procedure starts, the interface 40 receives a print start order from the user and the controller 50 acquires the print start order from the interface 40 (Step S201). Here, the user gives a print start order after placing the printing device 1 at the same position as where the user gave a decorative print start order.

Acquiring the print start order, the controller 50 acquires the print-target image 100 from the storage 60 (Step S202).

After the print-target image 100 is acquired, the amount of movement of the printing device 1 is acquired from the amount-of-movement measurer 30 and it is determined whether the amount of movement since acquisition of the print start order has reached the offset L (Step S203). If the amount of movement has not reached the offset L (NO in step S203), the determination is repeated until the amount of movement has reached the offset L.

If the amount of movement has reached the offset L (YES in step S203), the controller 50 determines whether it is first-time printing, in order words whether it is the first print procedure after the decorative print procedure is executed (Step S204).

If it is first-time printing (YES in step S204), the processor 51 controls the print head 22 to print the adjusted print-target part 101 (Step 5205) and ends the print procedure.

If it is non-first-time printing (NO in step S204), the processor 51 controls the print head 22 to print the combined image 103 (Step 5206) and ends the print procedure.

Figure 7A:
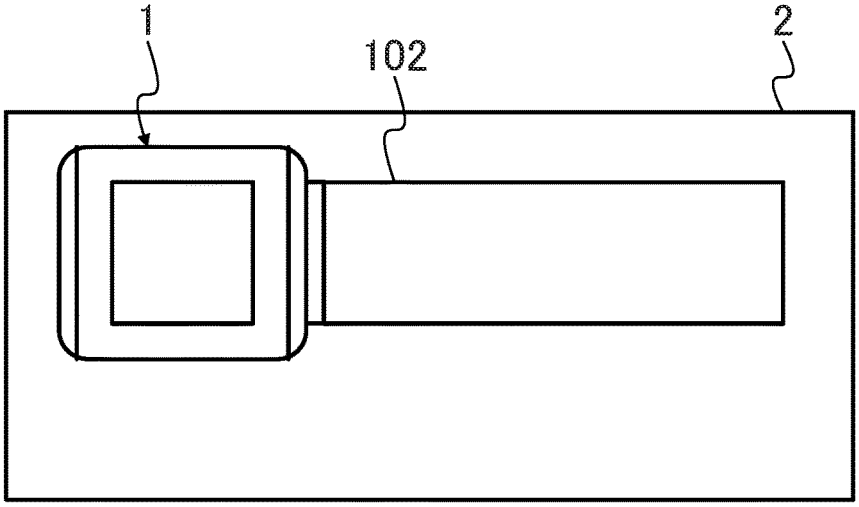
FIG. 7A is an illustration that shows the printing device and the print medium before first-time printing.
Figure 7B:
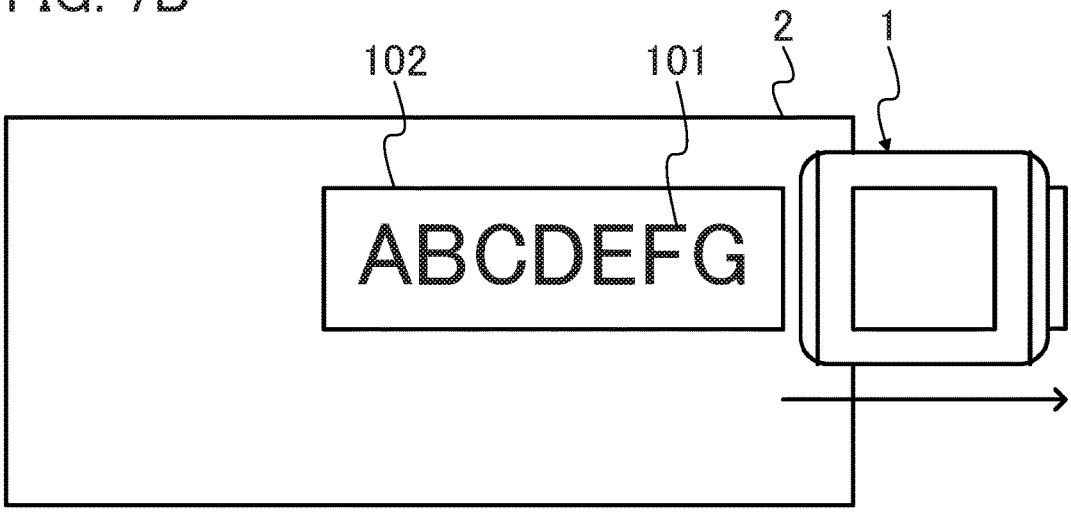
FIG. 7B is an illustration that shows the printing device and the print medium after first-time printing.

FIGS. 7A and 7B are illustrations that show the printing device 1 and the print medium 2 in first-time printing. As shown in FIG. 7A, the decorative image 102 is printed on the print medium 2. The user disposes the printing device 1 so that the marker 11 is positioned at the left end of the decorative image 102 and enters a print start order into the interface 40.

As shown in FIG. 7B, as the user scans the printing device 1 in the arrowed direction from left to right, the adjusted print-target part 101 is printed.

Figure 8A:
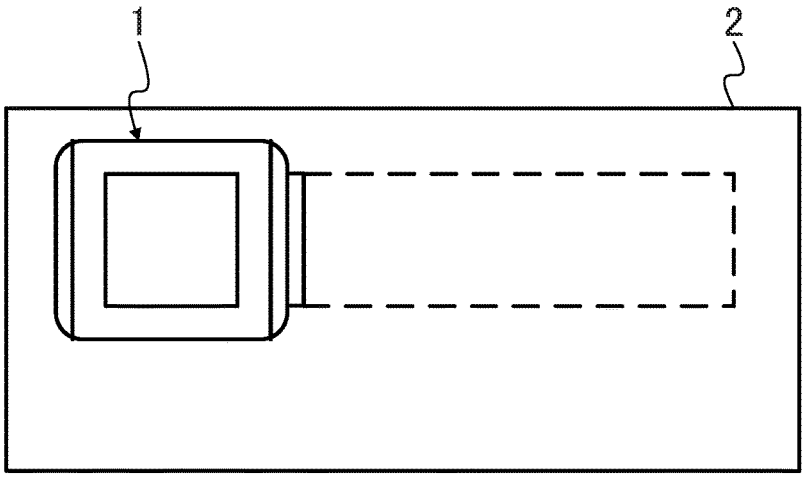
FIG. 8A is an illustration that shows the printing device and the print medium before non-first-time printing.
Figure 8B:
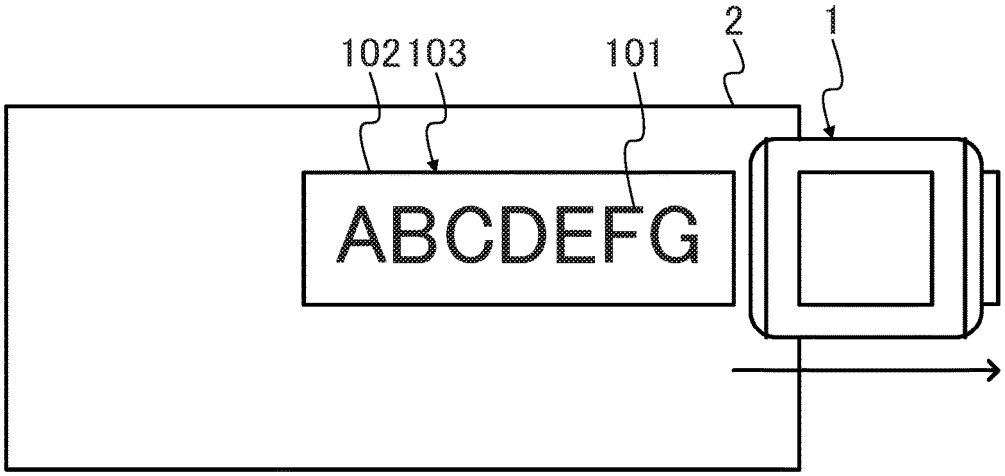
FIG. 8B is an illustration that shows the printing device and the print medium after non-first-time printing.

FIGS. 8A and 8B are illustrations that show the printing device 1 and the print medium 2 in non-first-time printing. The dashed lines in FIG. 8A indicate the range in which the user wants to print. As shown in FIG. 8A, the user disposes the printing device 1 so that the marker 11 is positioned at the left end of the range in which the user wants to print and enters a print start order into the interface 40.

As shown in FIG. 8B, as the user scans the printing device 1 in the arrowed direction from left to right, the combined image 103 of the decorative image 102 and the adjusted print-target part 101 is printed.

Including the above configuration and executing the decorative print procedure and the print procedure, the printing device 1 enables the user to easily view a print range that is set by the user.

The printing device 1 sets a print range based on the size of the decorative image 102 and sets the print-target image 100, whereby it is possible to adjust and print an image the user wants to print in a suitable size for a range in which the user wants to print.

The printing device 1 does not print outside the decorative image 102 that is printed by the user, whereby it is possible to prevent printing in an area where the user does not want to print such as outside the print medium 2 or an area where another image is already printed.

The printing device 1 prints the combined image 103 in which the print-target part 101 and the decorative image 102 are combined together when it is not first-time printing, whereby it is possible to print an image of a suitable size for a specified range multiple times by printing the decorative image 102 only one time for specifying a range.

The printing device 1 starts printing after the amount of movement has reached the offset L and therefore starts printing from a position where the user disposes the marker 11, whereby it is possible for the user to easily dispose the printing device 1 at the print start position.

Modified Embodiment

An embodiment of the present disclosure is described above. This embodiment is given by way of example and the scope of application of the present disclosure is not confined thereto. In other words, embodiments of the present disclosure find various applications and any embodiments are included in the scope of the present disclosure.

It is assumed that the print head 22 performs inkjet printing. However, this is not restrictive. Any print system including thermal print and thermal transfer print may be performed.

It is assumed that the amount-of-movement measurer 30 includes the LED 31 and the image sensor 32 and with the image sensor 32 reading light that is emitted by the LED 31 and reflected on the print medium 2, the amount-of-movement measurer 30 measures the amount of movement. However, this is not restricted. The amount-of-movement measurer 30 may include a roller or a ball that is disposed on the bottom surface of the enclosure 10 and measure the amount of movement by measuring their rotation. Moreover, it may be possible that a laser light source is included and with the image sensor 32 reading light that is emitted by the laser light source and reflected on the print medium 2, the amount of movement is measured.

Moreover, it is assumed that in the first-time print procedure, the user places the printing device 1 at the same position as where the user gave a decorative print start order and then gives a print start order. However, this is not restrictive. It may be possible to provide a scanner or an image sensor at the front of the print head 22 in the scan direction, detect the printed decorative image 102 while scanning, and start the print procedure when it is determined that the print head 22 enters the printed decoration range.

Figure 9A:
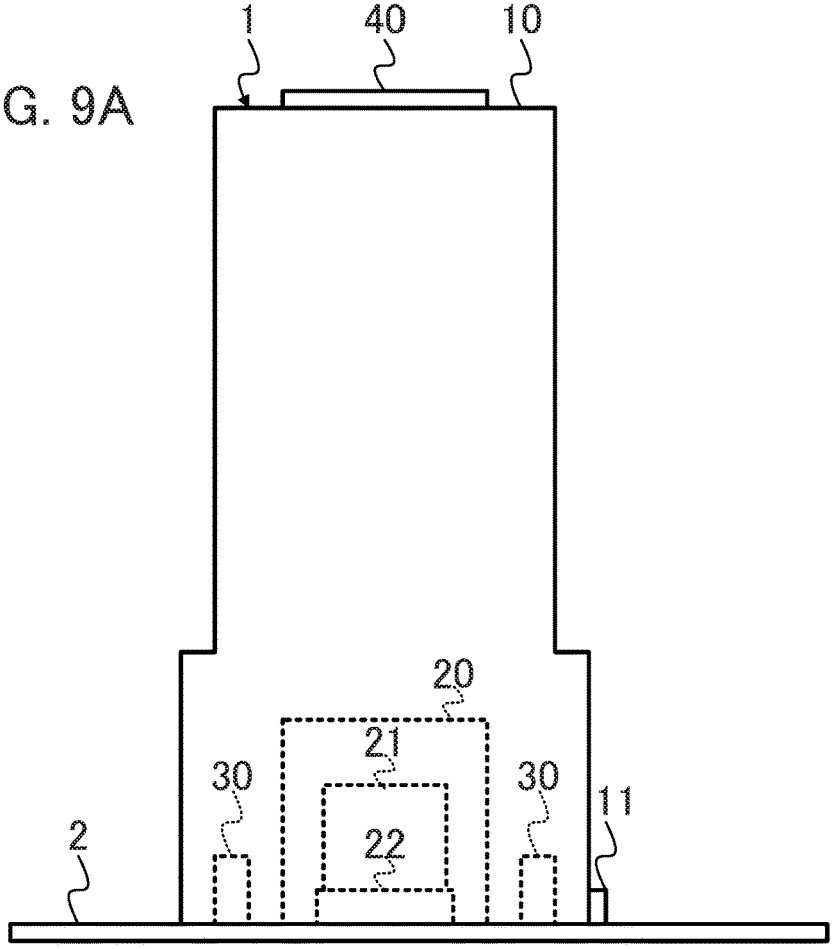
FIG. 9A is a side view of the printing device of a modified embodiment.
Figure 9B:
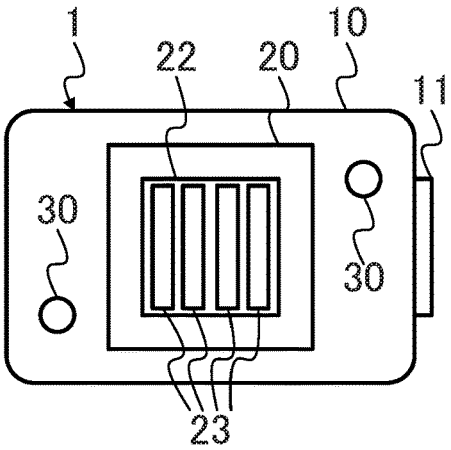
FIG. 9B is a bottom view of the printing device of the modified embodiment.

The printing device 1 may include multiple amount-of-movement measures 30. FIG. 9A is a side view of the printing device 1 of this modified embodiment and FIG. 9B is a bottom view thereof. As shown in FIGS. 9A and 9B, the printing device 1 of this modified embodiment includes two amount-of-movement measures 30. When a single amount-of-movement measurer 30 is provided, change in orientation, namely rotation, of the printing device 1 cannot be detected. With multiple amount-of-movement measures 30 being provided, change in orientation of the printing device 1 can be detected, whereby it is possible to set a print range and print with higher accuracy.

It is assumed that in the print procedure, the printing device 1 prints the adjusted print-target part 101 or the combined image 103 and then ends the print procedure. However, this is not restrictive. Assuming that the interface 40 receives a print end order from the user, the controller 50 may acquire information of reception of a print end order from the interface 40 and control the print head 22 to end the print procedure.

It is assumed that the printing device 1 prints a rectangular decorative image 102. However, this is not restrictive. The printing device 1 may print a circle, an ellipse, a polygon, or a figure that is enclosed by lines or curves as the decorative image 102. Moreover, symbols that indicate a range such as parentheses and underlines may be printed as the decorative image 102. Furthermore, the decorative image 102 that encloses a print range with a pattern or a figure including frame graphics may be printed.

The explanation is made on the assumption that the printing device 1 prints from left to right. However, this is not restrictive. The printing device 1 can print in any direction.

Needless to say, a printing device that preliminarily includes the configuration to realize the functions according to the present disclosure can be provided. Additionally, it is possible to make an existing information processing device or the like function as the printing device according to the present disclosure by applying the programs. In other words, it is possible to make an existing information processing device or the like function as the printing device according to the present disclosure by applying the programs for realizing the functions of the printing device that are exemplified in the embodiment and the modified embodiment in a manner that a CPU or the like that controls the existing information processing device or the like can execute the programs. The printing method according to the present disclosure can be implemented using a printing device.

Moreover, any method of applying such programs can be used. For example, the pragmas can be saved on a computer-readable storage medium such as a flexible disc, a compact disc (CD)-ROM, a digital versatile disc (DVD)-ROM, and a memory card and applied. Furthermore, the programs can be superimposed on carrier waves and applied via a communication medium such as the Internet. For example, the programs may be posted on a bulletin board system (BBS) on a communication network and distributed. Then, the programs are started and executed in the same manner as other application programs under the control of an operating system (OS) so as to execute the above-described procedures.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a print head that prints, on a print medium, image data of a print target and a decorative image; and a processor that controls the print head to print image data of the decorative image on the print medium while the printing device that is held by a user moves on the print medium in a first movement, wherein the processor causes the print head to print the image data of the print target in a range that is indicated by the printed decorative image while the held printing device moves on the print medium in a second movement after the image data of the decorative image is printed.

2. The printing device according to claim 1, wherein the processor sets a range that is indicated by the decorative image that is printed by the print head as a print range to print the image data of the print target, adjusts the image data of the print target based on the set print range, and causes the print head to print the image data of the print target that is adjusted by the adjuster in the print range when the held printing device moves on the print medium in the second movement.

3. The printing device according to claim 2, wherein the processor (i) creates a combined image in which the image data of the decorative image and the adjusted image data of the print target are combined together, and (ii) causes the print head to print the combined image.

4. The printing device according to claim 3, wherein the processor causes the combined image to be printed while the held printing device moves on the print medium after the second movement.

5. The printing device according to claim 2, wherein the processor enlarges or reduces the image data of the print target according to the set print range.

6. The printing device according to claim 1, further comprising:

a sensor that detects the image data of the decorative image that is printed on the print medium, wherein the processor causes the print head to print, within the decorative image, the image data of the print target when the sensor detects the image data of the decorative image that is printed on the print medium while the held printing device moves on the print medium in the second movement.

7. The printing device according to claim 1, wherein the processor starts printing the decorative image when an order to start printing the decorative image is given by the user, and ends printing of the decorative image when an order to end printing the decorative image is given by the user.

8. The printing device according to claim 7, wherein when the order to start printing the decorative image is given by the user, printing of the decorative image starts after the printing device that is held by the user moves on the print medium by an offset.

9. A printing method of a printing device that comprises a print head for printing image data of a print target on a print medium, wherein the following is executed:

a decorative print procedure in which the print head is controlled to print image data of a decorative image on the print medium while the printing device that is held by a user moves on the print medium in a first movement, and a print procedure in which the print head is controlled to print the image data of the print target in a range that is indicated by the printed decorative image while the held printing device moves on the print medium in a second movement after the image data of the decorative image is printed.

10. A non-transitory recording medium on which a program is recorded, the program causing a computer of a printing device that comprises a print head for printing image data of a print target on a print medium to execute the following processing:

controlling the print head to print image data of a decorative image on the print medium while the printing device that is held by a user moves on the print medium in a first movement and controlling the print head to print the image data of the print target in a range that is indicated by the printed decorative image while the held printing device moves on the print medium in a second movement after the image data of the decorative image is printed.

* * * * *